United States Patent [19]

Rodek et al.

[11] 3,961,236

[45] June 1, 1976

[54] CONSTANT POWER REGULATOR FOR XEROGRAPHIC FUSING SYSTEM

[75] Inventors: Victor Rodek, Rochester; Thomas B. Michaels, Pittsford, both of N.Y.

[73] Assignee: Xerox Corporation, Stamford, Conn.

[22] Filed: Feb. 7, 1975

[21] Appl. No.: 547,932

[52] U.S. Cl. ..... 323/18; 307/252 UA; 323/20; 323/21; 323/24

[51] Int. Cl.[2] ..... G05F 1/44

[58] Field of Search ..... 307/133, 252 UA; 323/18, 20, 21, 22 SC, 24

[56] References Cited

UNITED STATES PATENTS

| | | | |
|---|---|---|---|
| 3,283,179 | 11/1966 | Carlisle et al. | 307/133 |
| 3,458,801 | 7/1969 | Polson | 323/21 |
| 3,466,572 | 9/1969 | Hanna et al. | 323/21 UX |
| 3,599,037 | 8/1971 | Grace | 323/21 UX |
| 3,818,307 | 6/1974 | Hamilton et al. | 323/20 X |

OTHER PUBLICATIONS

Van Cleave et al., "Complete Half-Wave Thyrister Control", IBM Tech. Disc. Bull., vol. 16, No. 9, Feb. 1974, p. 2962.

*Primary Examiner*—A. D. Pellinen

[57] ABSTRACT

A constant power regulator for a xerographic fuser in which power control is achieved by taking the sum of the load voltage and current. The regulator includes an operational amplifier connected as a voltage adding circuit. The operational circuit amplifier of the power regulator adds the voltage drop across the fuser and a reference resistor connected in series with the fuser and the voltage drop across the fixed reference resistance which represents the current flow through the fuser. The output of this summing circuit is detected by a photodetector that electrically isolates the power regulator from a voltage regulator which has an output for controlling the power supply to the fuser through, for example, a triac, controlled as a function of the power supply signal and the detected voltage generated by the power regulating circuit.

1 Claim, 5 Drawing Figures

CONSTANT POWER REGULATOR FOR XEROGRAPHIC FUSING SYSTEM

BACKGROUND OF THE INVENTION

The present invention relates generally to the power regulating and copying arts. More particularly, the invention is concerned with providing a power regulating circuit for controlling the power supplied to fusing apparatus of a xerographic or similar copying machine.

In a xerographic copying machine a resistance heating element is usually employed to fuse the toner image to the supporting copy sheet before the copy is made available to the operator. The apparatus of this invention is intended to regulate the supply of power to the fuser heater to maintain the supply constant irrespective of variations in line voltage or load resistance.

In the process of xerography, for example, as disclosed in Carlson U.S. Pat. No. 2,297,691, issued Oct. 6, 1942, a xerographic plate comprising a layer of photoconductive insulating material on a conductive backing is given a uniform, electric charge over its surface and is then exposed to the subject matter to be reproduced, usually by conventional projection techniques. This exposure discharges the plate areas in accordance with the radiation intensity that reaches them, and thereby creates an electrostatic latent image on or in the photoconductive layer. Development of the latent image is effected with an electrostatically charged, finely divided material such as an electroscopic powder that is brought into surface contact with the photoconductive layer and is held thereon electrostatically in a pattern corresponding to the electrostatic latent image. Thereafter, the developed xerographic powder image is usually transferred to a support surface to which it may be fixed by any suitable means.

Xerography has gained wide commercial success as a convenient and accurate method for the reproduction of copy, producing copy of high resolution. One of the virtues of xerography is its ability to reproduce copy onto a variety of support surfaces that are not sensitized in advance, as is done, for example, in photography. The application of heat to affix xerographic powder images to support surfaces has been extensively employed and typical fusing apparatus for affixing powder images to moving support surfaces is disclosed in Crumrine U.S. Pat. No. 2,852,651.

In the interest of maintaining a consistent degree of fusing fix, it is necessary that the power delivered to the fusing device be maintained at or above some specific minimum value over the tolerance range of line voltage and heater resistance. For certain types of fusing systems, for example, a CHOW fuser, it is possible to perform a worst case design to assure required power, and to allow "on-off" cycling of the fuser lamp via the temperature controller under higher power conditions. However, when the danger exists of exceeding the rating of the assigned power line, or when low inertia (radiant) fusing devices are used, it becomes important to regulate fuser power. This is accomplished by a line power regulator to hold constant the input power to the fuser, automatically compensating for variations both in the line voltage and in the load (the fuser lamp resistance).

Constant power regulators are known in which both the voltage across the load and the current through the load are detected and multiplied in a multiplier circuit to give the total power consumption, and the input power is then regulated up or down to maintain this power consumption constant. The multiplier circuits make such power regulators both complex and costly.

The present circuit, on the other hand, utilizes a summing circuit for summing, rather than multiplying, the load current and load voltage. This provides, in a simpler and cheaper circuit, an approximation of the power consumption which is utilized to control the power input. The percentage accuracy of power consumption with this approximation is quite adequate for a fuser over relatively wide ranges of fuser resistances, and input voltage fluctuations. The summing circuit can be a simple operational amplifier circuit with two commonly connected inputs from, respectively, a voltage tap across the fuser and a tap measuring the current through the fuser. The current input can be the voltge developed across a small resistor in series with the fuser. By selecting the proper resistances of the two input lead resistors, the input voltage contribution from the voltage and current measuring taps can be made equal. This voltage and current control would be in addition to the conventional fuser temperature controls.

DESCRIPTION OF THE PREFERRED EMBODIMENT

Figure 1:
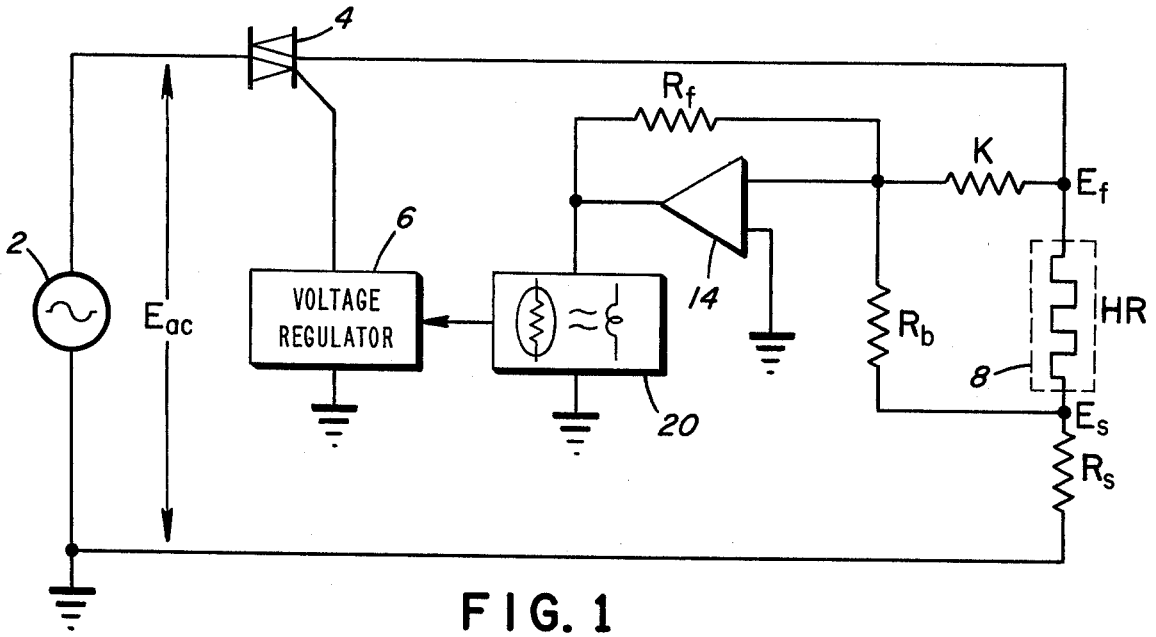
FIG. 1 is a generalized circuit diagram of the fuser power regulating circuit.

FIG. 1 shows a circuit diagram of the constant power regulator of this invention. An A.C. line voltage, nominally 115 volts, 50–60 cycle, is applied from source 2, through a switching device 4, such as a triac, to a fuser element 8 which is connected in series with a resistor $R_s$. A voltage regulator circuit 6 has an output terminal connected to the gate electrode of the triac to control the triggering of the triac and consequently the supply of A.C. voltage to the fuser. The voltage regulator is controlled as a function of the output of a constant power regulator. A sensing device 20 detects and measures the power regulator output, and applies the measured output as a control voltage to the voltage regulator 6, to be described in more detail below.

Figure 2:
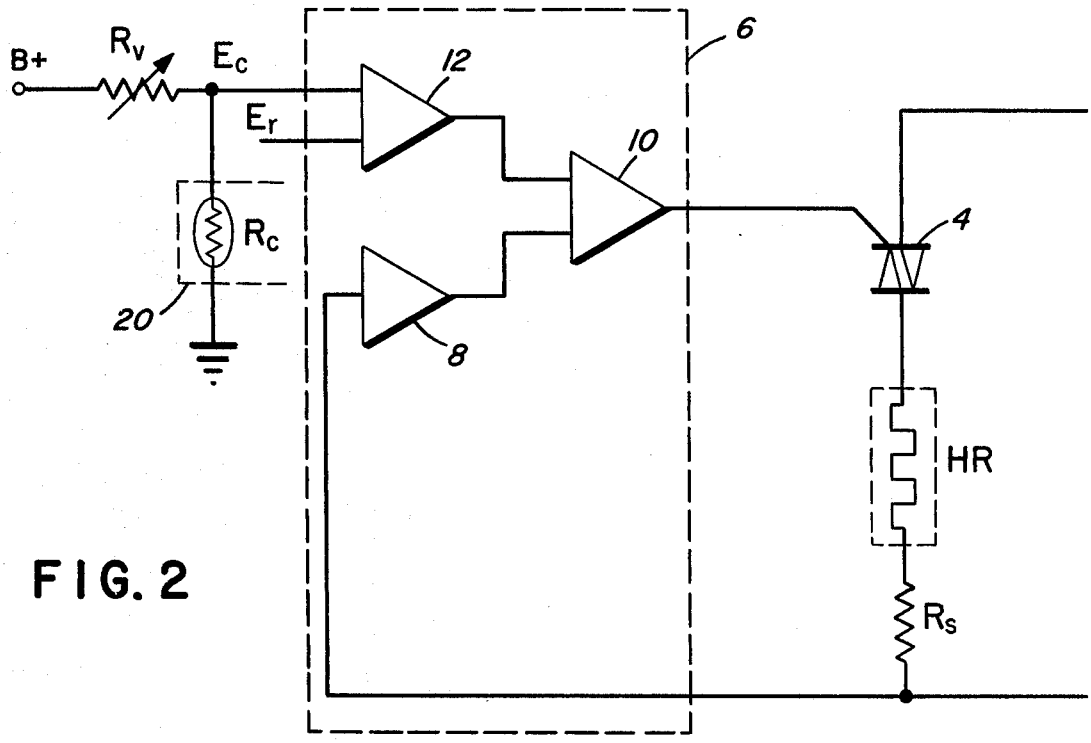
FIG. 2 shows the voltage regulator circuit.

Referring to FIG. 2, the voltage regulator 6 comprises a zero crossing detector 8 having its input coupled to the A.C. line voltage source 2. The zero crossing detector produces an output signal when the A.C. line voltage crosses the zero voltage level. The zero crossing detector output is connected to one input of a triac gate circuit 10 whose output is connected to the triac gate terminal. A second input of the triac gate circuit 10 is connected to the output of an ON/OFF sensing amplifier 12.

One input of ON/OFF sensing amplifier 12 is connected to a reference voltage $E_r$; a second input of amplifier 12 is connected to the intermediate tap of a voltage divider consisting of variable resistor $R_r$ and a cadmium sulfide photocell, represented as resistance $R_c$. The amplifier 12 has the characteristic that its output goes to zero only when the intermediate tap voltage $E_c$ is less than or equal to the reference voltage $E_r$.

The triac gate circuit 10 produces a triac inhibit signal when the A.C. line voltage detected by detector 8 crosses the zero reference line and $E_c$ is less than or equal to $E_r$. At this time, triac 4 will be triggered out of conduction to inhibit the supply of power from source 2 to the fuser circuit (HR, $R_s$). Gate circuit 10 produces a triac trigger signal when the zero crossing detector detects the next zero voltage level crossing of the A.C. source signal. The triac is triggered into conduction again, thereby permitting current to flow through the fuser circuit. Voltage regulator circuits of this type are described in U.S. Pat. No. 3,833,790, issued Sept. 3, 1974 to D. J. Quant et al and U.S. Pat. No. 3,833,794, issued Sept. 3, 1974 to M. Moriyama; a voltage regulator circuit of the type applicable here is the Texas Instruments, Inc. Ser. No. 72,440, described in "Linear and Interface Circuit Applications", edited by D. E. Pippenger and C. L. McCollum, Texas Instruments, Inc., 1974, pp. 151–153.

Photocell $R_c$ comprises one portion of the sensing device 20; the complete device may be a known photomodule which also includes incandescent control lamp CL (FIG. 4), connected to the constant voltage output of power regulating circuit 14. The use of a photomodule to measure the power regulator output voltage has the advantages of providing electrical isolation between the power and voltage regulators and also permitting the apparatus to operate with low power requirements.

Figure 3A:
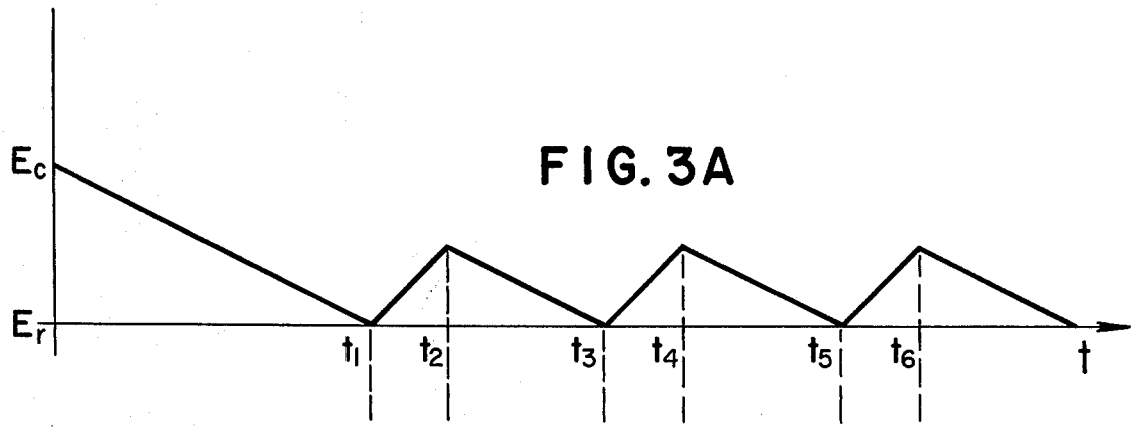
FIGS. 3A and 3B are waveform diagrams of the input to the sensing amplifier of the voltage regulator circuit and the A. C. voltage applied to the fuser, respectively.
Figure 3B:
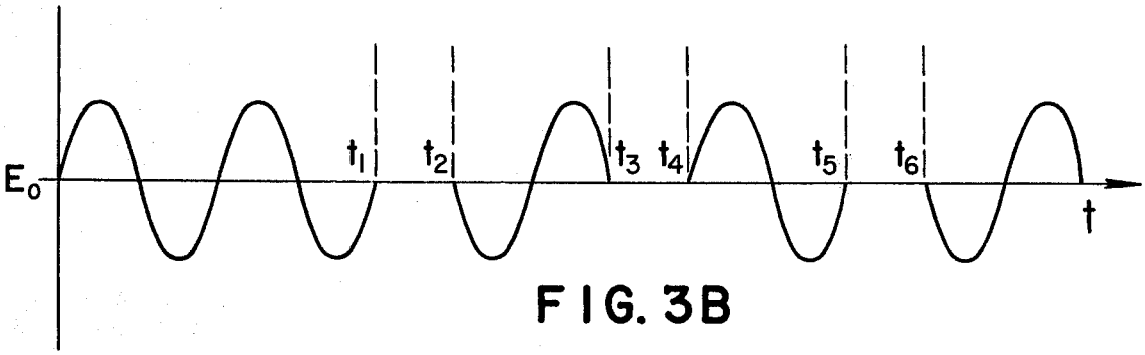

The operation of the voltage regulator circuit will be described with reference to FIGS. 3A and 3B. When power is initially supplied to the fuser from the A.C. supply 2, (by switching means which are not shown and which form no part of this invention), the lamp CL is OFF. At this time the photocell resistance $R_c$ is high, and much larger than resistance $R_v$; therefore when line voltage $E_{ac}$ is initially applied, $E_c$ is greater than $E_r$, and the output of sensing amplifier 12 will remain at a high level as long as this relationship holds. During the period that $E_c$ is greater than $E_r$, the output of triac gating circuit 10 maintains the triac 4 in its conductive state. As long as the A.C. supply is provided to the fuser, the control lamp CL will be lit. Resistance $R_c$ of the photodetector decreases as a function of the length of time lamp CL remains on; intermediate tap voltage $E_c$ decreases in direct relationship to decreasing resistance $R_c$ until the point is reached where $E_c$ is equal to or less than $E_r$. At this point the output of sensing amplifier 12 goes to zero and remains there as long as $E_c$ is less than or equal to $E_r$. When the A.C. signal next crosses the zero voltage line, thereby producing an output from detector 8, the output of triac gating circuit 10 will go to zero. Inhibiting the output of gating circuit 10 causes triac 4 to shut off, thereby cutting off power to the fuser 8.

Shutting off power to the fuser 8 also shuts off power to control lamp CL in shunt with the fuser element. When the control lamp goes dark, photocell resistance $R_c$ rises, causing intermediate tap voltage $E_c$ to rise accordingly; sensing amplifier 12 is triggered to produce a high output when $E_c$ becomes greater than $E_r$ and triac gating circuit 10 triggers the triac 4 into conduction again when zero crossing detector 8 next detects the zero voltage crossing of the A.C. line voltage. As shown in FIG. 3B, the triac 4 is triggered off at time $t_1$ and remains off until triggered on again at time $t_2$.

The inhibiting action continues at times $t_3$, $t_5$, . . . etc. In the disclosed embodiment, the photocell turn-on time, which is a function of the magnitude of $E_{ac}$ and cell-lamp parameters, is greater than the turn-off time. The photocell used in this embodiment is part of a photomodule 106P86, and has a turn-on response time between 600 ms and 1200 ms and a turn-off time of 500 ms maximum.

In the example shown, one half-cycle out of three half-cycles is inhibited so that the power delivered to the controlling lamp (and load) is ⅔ of the available power. In general, if N = number of ½ cycles ON,
and $n$ = number of ½ cycles OFF,
the power delivered to the load (Pd) is $$Pd = Pa\ N/N + n$$

where Pa = available power. Also, in general, if $E_o$ = RMS voltage at the controlling lamp (and load) and $E_{ac}$ = applied voltage, and if the load resistance does not change, then $$E_o = E_{ac} \sqrt{\frac{N}{n+N}}$$

The magnitude of $E_o$ can be varied by means of $R_v$ (FIG. 2) which controls the value $E_c$ with respect to the fixed reference voltage $E_r$. The regulator tends to maintain a constant RMS voltage at its controlling lamp and any load that may be in shunt with the controlling lamp, i.e. the fuser element HR.

As noted above, the response times of the photocell are dependent upon the magnitude of $E_{ac}$ and the control lamp characteristics. The light intensity generated by the control lamp varies with the power supply voltage; the intensity of the control lamp will, of course, affect the response characteristics of the photocell and thus the voltage regulating characteristics of regulator 6. The control lamp voltage is affected by changes in the resistance of the fuser heater element which in turn is affected by age, changes in temperature or humidity, etc. It is therefore desirable to maintain the voltage supply to the control lamp as constant as possible over a wide range of fuser resistances; the power regulating circuit of this invention is provided for this purpose.

The power regulator circuit includes an operational amplifier 14 operating as a summing circuit with two commonly connected inputs. One input is tapped at point $E_f$ representing the voltage drop across the fuser resistance HR and the second input is tapped at $E_s$, the junction of fuser HR and resistor $R_s$; the latter tap represents a measurement of the current through the fuser. By selecting the proper resistances of the two input lead resistances K and $R_b$, the input voltage contributions from each of the voltage and current measuring taps can be made substantially equal. The summing circuit output is supplied to a load comprising control lamp CL. The radiation intensity of the lamp is a function of the summing circuit output voltage.

The power regulating circuit tends to maintain the lamp voltage Ecl constant over a range of varying fuser resistances. Representing the fuser as having possible resistances $R_1$ and $R_2$ ($R_2 = R_1 \pm \Delta R_1$), and where $R_s$ is the value of the current measuring resistor, we have:

$$Ecl = I_1 (R_1 + R_s) + KI_1R_s = I_2 (R_2 + R_s) + KI_2r_s \qquad (1)$$

$$= E_1 + K \frac{E_1 \quad R_s}{R_1 + R_s} = E_2 + K \frac{E_2 \quad R_s}{(R_2 + R_s)}, \tag{2}$$

where $E_1$, $E_2$ are values of voltage $E_f$ for fuser resistances $R_1$, $R_2$, respectively. Now assume equal voltage and current weighting at the summing network and let $$K \cdot \frac{E_1 \quad R_s}{(R_1 + R_s)} = E_1, \tag{3}$$

and let $R_1$ and $R_2 >> R_s$.
Then from (3)

$$KR_s = R_1 \tag{4}$$

So that from (2)

$$2E_1 = E_2 (1+R_1/R_2) \tag{5}$$

From which $$E_2 = \frac{E_1 2R_2}{(R_1 + R_2)} \tag{6}$$

Evaluating power regulation of this system in terms of $R_1$ and $R_2$, using (6), $$E_2^2/R_2 = E_1^2/R_1 \cdot \frac{4R_1R_2}{(R_1 + R_2)^2} \tag{7}$$

which shows that as the load resistance varies from $R_1$ to $R_2$ the power delivered to the load varies by the factor $$\frac{4R_1R_2}{(R_1 + R_2)^2} \tag{8}$$

Note that if $R_1 = R_2$, the error factor = 1.
Evaluation of the error factor (8) for a range of load resistance change values shows that power regulation by summing means may be achieved with good accuracy over a wide range of load resistance changes.

Figure 4:
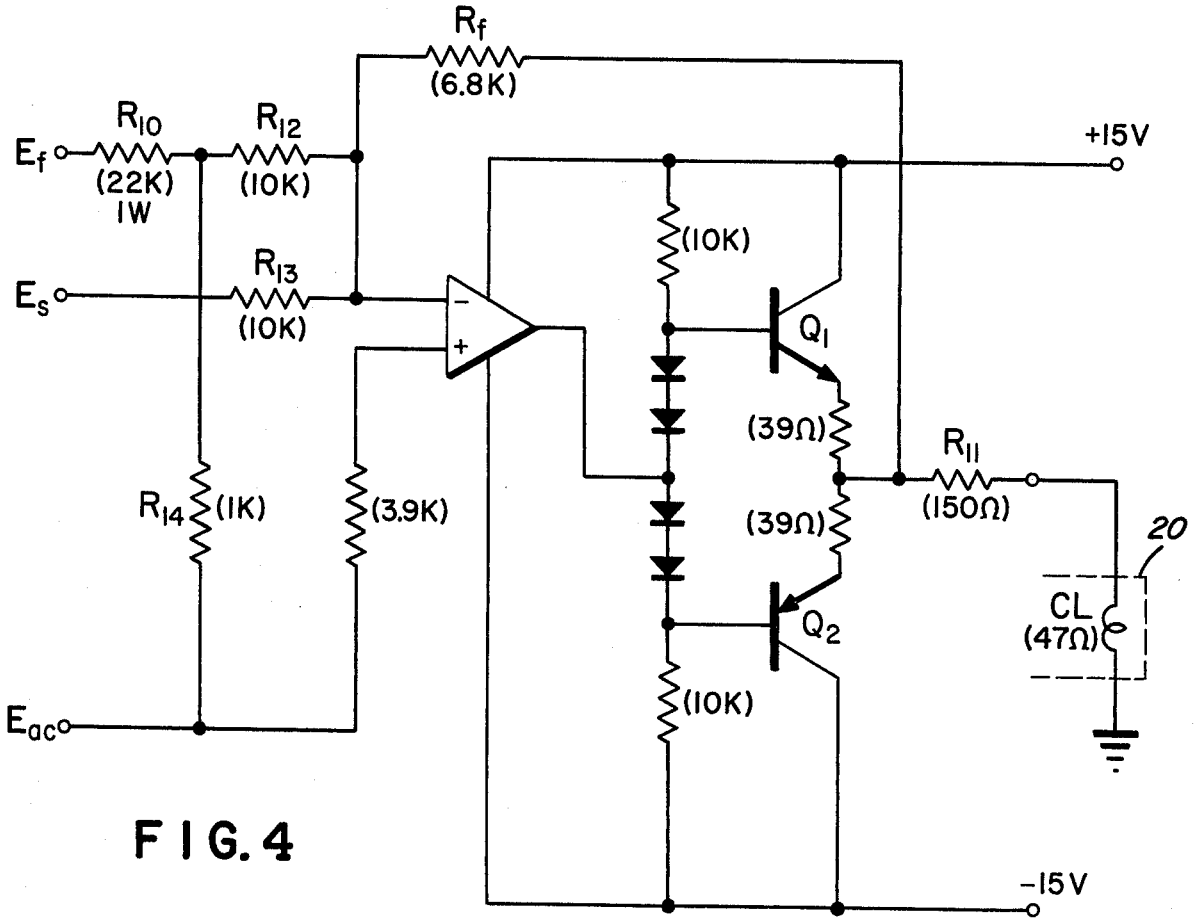
FIG. 4 is a circuit diagram of an exemplary power regulating operational amplifier circuit.

An exemplary operational amplifier summing network used in this invention is shown in FIG. 4. The voltage and current taps are taken from inputs $E_f$ and $E_s$; the voltage at input $E_f$ is dropped across a voltage divider consisting of resistors R10 and R14 to provide nominally equal input voltages across resistors R12 and R13, both of which are 10 K resistors. The amplifier itself is a commercially available module No. U741C; other applicable operational amplifiers are described in the above-mentioned Texas Instruments book. All diodes are 1 N4002 and transistors $Q_1$ and $Q_2$ are 2N3904 and 2N3906, respectively. Resistor $R_{11}$ is a current limiting resistor providing a nominal 1.50 volt output to the control lamp CL. The control lamp has a nominal resistance of 47 ohms.

Power measurements made on the above circuit at line voltage variations from 105 to 125 volts A.C. show that power remains constant to within less than 2% maximum variation.

The power regulator of this invention is advantageous in that it uses a relatively simple and low-cost summing circuit with good power regulation capability.

The power regulation concept described and claimed herein is not limited in scope to triac controlled A.C. loads, but it can be applied to any power regulation problem employing feedback control of an active device. For instance, for D.C. power control, the circuitry described herein could be used to modify the duty cycle of a chopper regulator or the bias of a pass transistor.

It is to be understood that various modifications in the structural details of the preferred embodiment described herein may be made within the scope of this invention and without departing from the spirit thereof. It is intended that the scope of this invention shall be limited solely by the hereafter appended claims.

What is claimed is:

1. In a constant power regulator circuit for a variable impedance load which is coupled to a variable voltage alternating current power source, the improvement comprising:

a summing circuit for maintaining substantially constant the power applied to said variable impedance load as a direct function of the voltage across said variable impedance load plus the current through said variable impedance load, wherein said summing circuit comprises;

a first voltage tap from said variable impedance load providing a first voltage signal proportional to the voltage applied across said variable impedance load, a fixed current measurement impedance in series with said alternating current power source and said variable impedance load, said fixed current measurement impedance having a second voltage tap providing a second voltage signal corresponding to the current through said variable impedance load, an amplifier having a voltage responsive input, first resistance means connecting said input of said amplifier with said first voltage tap to connect said first voltage signal to said amplifier input, second resistance means connecting said second voltage tap to the same said input of said amplifier to connect said second voltage signal thereto and to sum said first and second voltage signals at said same input of said amplifier, said first and second resistance means and said fixed current measurement impedance having values selected to nominally provide substantially equal first and second said voltage signals to said input of said amplifier, said amplifier providing an output control signal controlled by said input; and wherein zero crossing control means are connected between said alternating current power source and said variable impedance load to control the power applied to said variable impedance load, said control means being operative at zero crossing conditions of said alternating current power source, said zero crossing control means being controlled by said output control signal from said amplifier of said summing circuit.

* * * * *